US012692641B2

(12) United States Patent
Gunn et al.

(10) Patent No.: US 12,692,641 B2
(45) Date of Patent: Jul. 28, 2026

(54) LAUNDRY APPLIANCE BALANCE RING

(71) Applicant: Haier US Appliance Solutions, Inc., Wilmington, DE (US)

(72) Inventors: Tanner Davis Gunn, Louisville, KY (US); Cody Ewing, Floyds Knobs, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 85 days.

(21) Appl. No.: 18/820,852

(22) Filed: Aug. 30, 2024

(65) Prior Publication Data

US 2026/0062852 A1 Mar. 5, 2026

(51) Int. Cl.

| | |
|---|---|
| ***D06F 37/24*** | (2006.01) |
| ***D06F 23/04*** | (2006.01) |
| ***D06F 37/12*** | (2006.01) |

(52) U.S. Cl.

CPC ..... *D06F 37/245* (2013.01); *D06F 23/04* (2013.01); *D06F 37/12* (2013.01)

(58) Field of Classification Search

None

See application file for complete search history.

(56) References Cited

U.S. PATENT DOCUMENTS

| | | | |
|---|---|---|---|
| 9,150,994 | B2 | 10/2015 | Davis |
| 10,316,451 | B2 | 6/2019 | Alexander et al. |
| 2013/0167596 | A1 | 7/2013 | Kang et al. |
| 2016/0083890 | A1 | 3/2016 | Shin |
| 2017/0226682 | A1 | 8/2017 | Duckworth |

FOREIGN PATENT DOCUMENTS

| | | | |
|---|---|---|---|
| KR | 20130080222 | A | 7/2013 |

*Primary Examiner* — Rita P Adhlakha

(74) *Attorney, Agent, or Firm* — Dority & Manning, P.A.

(57) ABSTRACT

A laundry appliance includes a cabinet, a tub positioned within the cabinet, a basket rotatably mounted within the tub and defining a chamber for receipt of articles, and a balance ring. The balance ring is positioned on the basket and defines a balance ring interior. The balance ring includes a fluid inlet extending into the balance ring interior such that the fluid inlet permits fluid to flow into the balance ring interior. Additionally, the balance ring includes a fluid retaining wall protruding from a surface into the balance ring interior. After the fluid flows into the balance ring interior, rotation of the basket permits the fluid to collectively move onto the fluid retaining wall for providing balance to the basket during rotation of the basket.

20 Claims, 7 Drawing Sheets

LAUNDRY APPLIANCE BALANCE RING

FIELD OF THE INVENTION

The present disclosure relates generally to laundry appliances, or more specifically, to balance rings of laundry appliances.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. Washing machine appliances also generally include a door that can be opened to provide access to the wash chamber and closed to prohibit access to the wash chamber. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc. During a spin or drain cycle, a drain pump assembly may operate to discharge water from within sump.

A significant concern during operation of washing machine appliances, and laundry appliances generally, is an out-of-balance condition. For example, articles and fluid within a basket may not be equally weighted about a central axis of the basket and tub. Accordingly, when the basket rotates, such as during a spin cycle, the imbalance in weight may cause the basket to be out-of-balance within the tub such that the axis of rotation does not align with the axis of the basket or tub. Such out-of-balance issues can cause the basket to contact the tub during rotation and can further cause movement of the tub within the cabinet. Significant movement of the tub can, in turn, generate increased noise, vibrations, and/or cause excessive wear and premature failure of appliance components such as the suspension, motor, etc.

Accordingly, a laundry appliance having a basket balancing component would be desirable. More specifically, a balance ring that is capable of correcting an out-of-balance condition of a laundry appliance would be particularly beneficial.

BRIEF DESCRIPTION OF THE INVENTION

Aspects and advantages of the invention will be set forth in part in the following description, or may be apparent from the description, or may be learned through practice of the invention.

In another exemplary embodiment, a top load washing machine appliance is provided. The top load washing machine appliance defines a vertical direction, a lateral direction, and a transverse direction. The top load washing machine appliance includes a cabinet and a tub positioned within the cabinet. Additionally, the top load washing machine appliance includes a vertically oriented basket rotatably mounted within the tub. The basket defines a wash chamber for receipt of articles for washing. Furthermore, the top load washing machine appliance includes a balance ring positioned on a bottom of the basket. The balance ring defines a balance ring interior. The balance ring includes a fluid inlet extending radially into the balance ring interior such that the fluid inlet permits fluid to flow radially into the balance ring interior. Moreover, the balance ring includes a fluid retaining wall protruding from a surface within the balance ring interior. Additionally, after the fluid flows into the balance ring interior, rotation of the basket permits the fluid to collectively move onto the fluid retaining wall for providing balance to the basket during rotation of the basket.

In one exemplary embodiment, a laundry appliance is provided. The laundry appliance defines a vertical direction, a lateral direction, and a transverse direction. The laundry appliance includes a cabinet a tub positioned within the cabinet. Additionally, the laundry appliance includes a basket rotatably mounted within the tub. The basket defines a chamber for receipt of articles. Additionally, the basket includes an interior end surface and an interior circumferential surface extending from the interior end surface. Furthermore, the laundry appliance includes a balance ring positioned on the basket. The balance ring defines a balance ring interior. The balance ring includes a fluid inlet extending radially from the interior circumferential surface of the basket into the balance ring interior such that the fluid inlet permits fluid to flow from the basket into the balance ring interior. Moreover, the balance ring includes a fluid retaining wall protruding from a surface into the balance ring interior. Additionally, after the fluid flows into the balance ring interior, rotation of the basket permits the fluid to collectively move onto the fluid retaining wall for providing balance to the basket during rotation of the basket.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
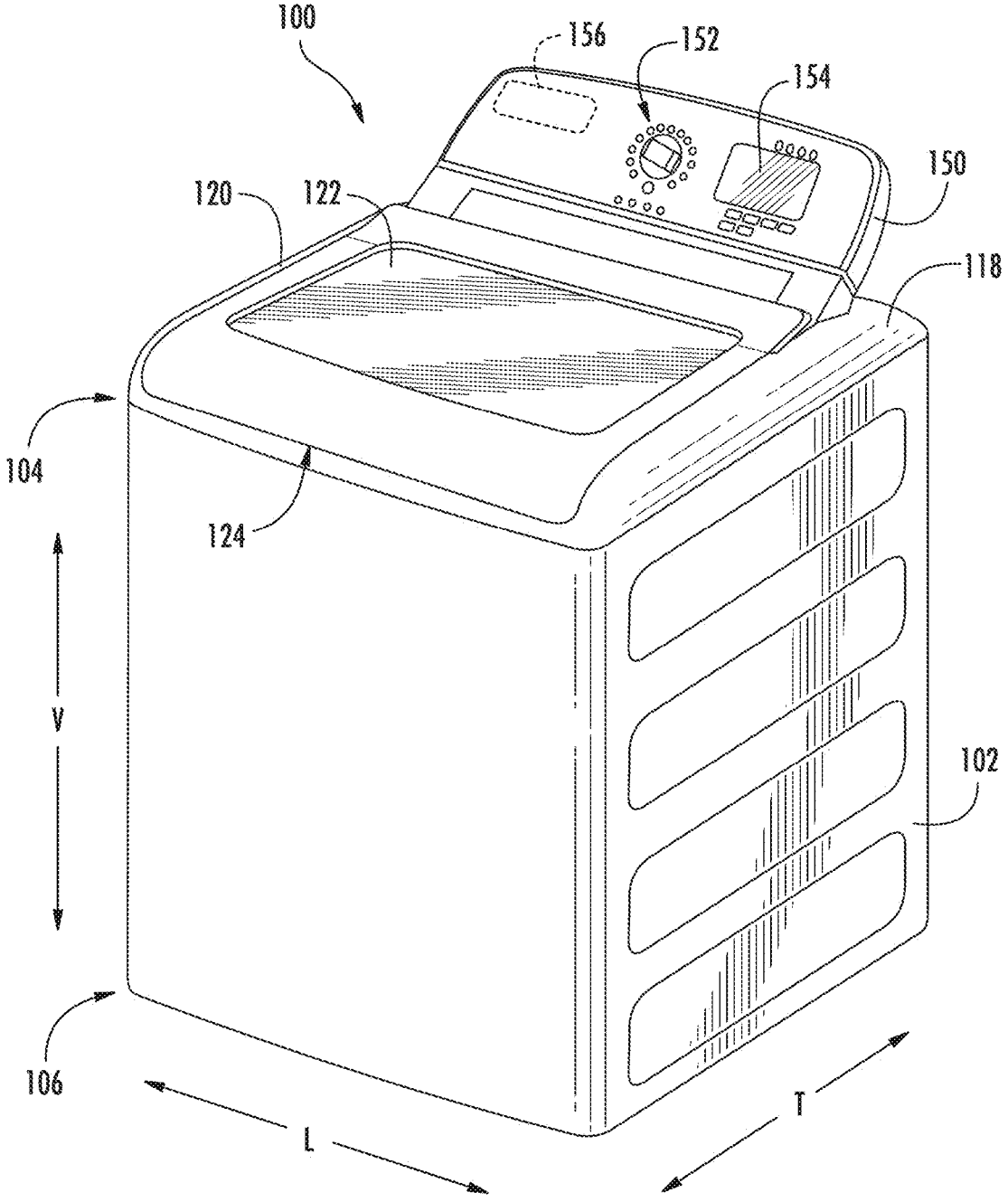
FIG. 1 provides a perspective view of a washing machine appliance according to an exemplary embodiment of the present subject matter with a door of the washing machine appliance shown closed.

Reference now will be made in detail to embodiments of the invention, one or more examples of which are illustrated in the drawings. The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). The term "at least one of" in the context of, e.g., "at least one of A, B, and C" refers to only A, only B, only C, or any combination of A, B, and C. In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Figure 2:
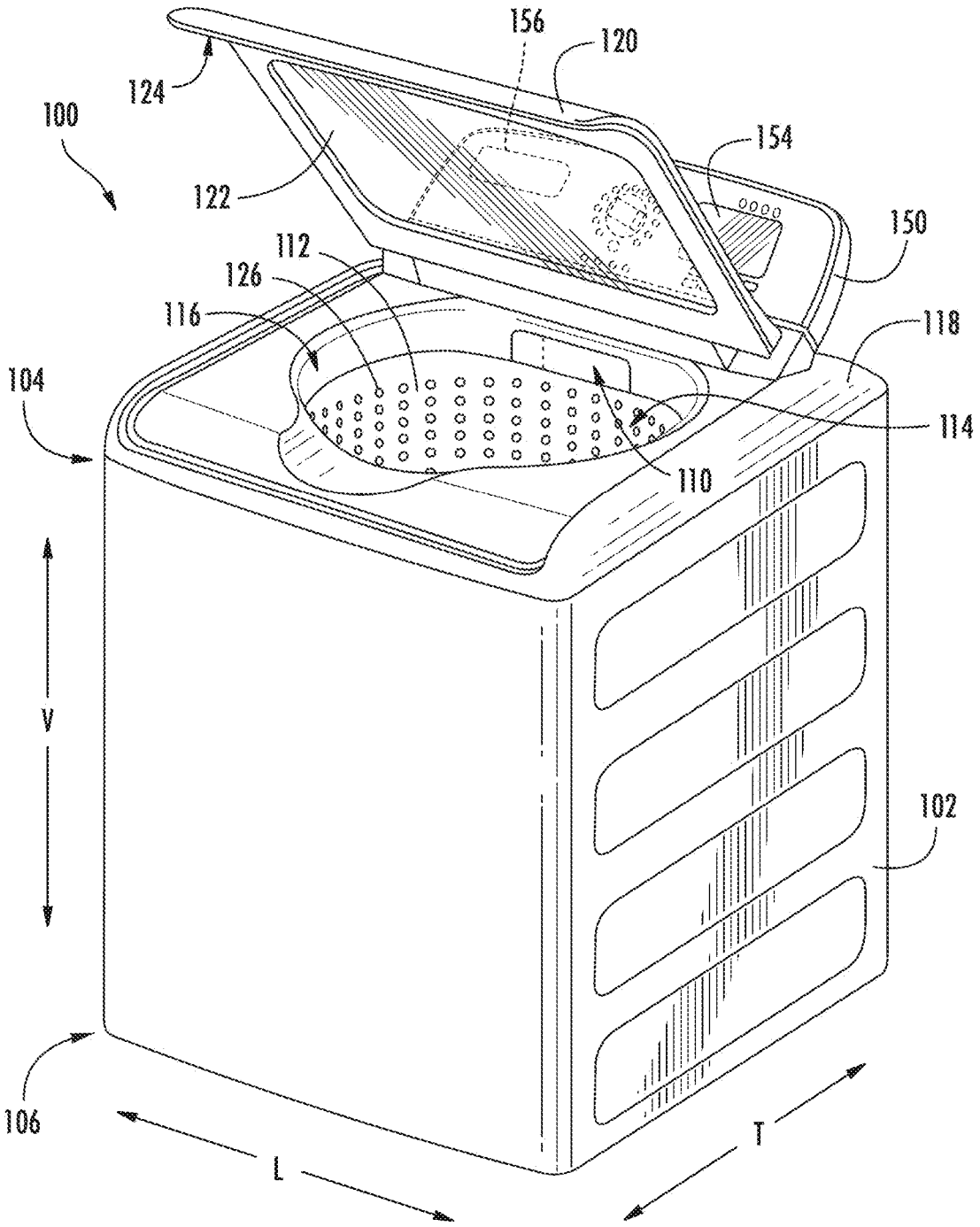
FIG. 2 provides a perspective view of the washing machine appliance of FIG. 1 with the door of the exemplary washing machine appliance shown open.
Figure 3:
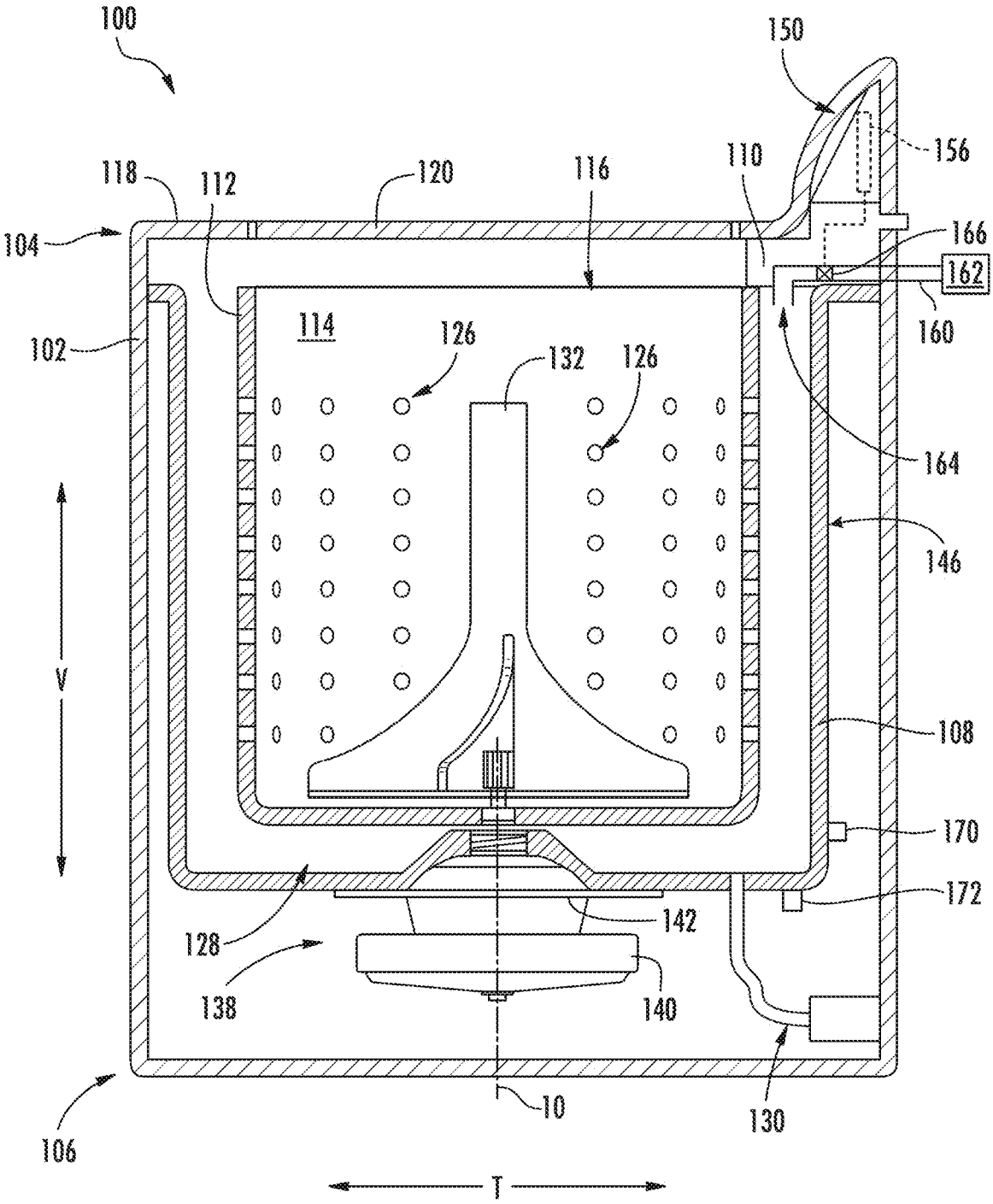
FIG. 3 provides a side, cross-sectional view of the washing machine appliance of FIG. 1 according to an exemplary embodiment of the present subject matter.

Referring now to the figures, FIGS. 1 through 3 illustrate an exemplary embodiment of a vertical axis washing machine appliance 100. Specifically, FIGS. 1 and 2 illustrate perspective views of washing machine appliance 100 with a door closed and open, respectively. FIG. 3 provides a side cross-sectional view of washing machine appliance 100. Washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, it should be appreciated that vertical axis washing machine appliance 100 is provided by way of example only. It will be understood that aspects of the present subject matter may be used in any other suitable laundry appliance, such as a horizontal axis washing machine appliance, a combination washer/dryer appliance, or the like. Indeed, modifications and variations may be made to washing machine appliance 100, including different configurations, different appearances, and/or different features while remaining within the scope of the present subject matter.

Washing machine appliance 100 has a cabinet 102 that extends between a top portion 104 and a bottom portion 106 along the vertical direction V. As best shown in FIG. 3, a tub 108 is positioned within cabinet 102 and is generally configured for retaining wash fluids during an operating cycle. Washing machine appliance 100 further includes a dispenser drawer 110 (FIG. 2) for dispensing wash fluid into tub 108. The term "wash fluid" refers to a fluid, such as a liquid and/or vapor (e.g., steam), used for washing and/or rinsing articles during an operating cycle and may include any combination of water, detergent, fabric softener, bleach, and other wash additives or treatments.

In addition, washing machine appliance 100 includes a wash basket 112 that is positioned within tub 108 and generally defines a wash chamber 114 including an opening 116 for receipt of articles for washing. More specifically, wash basket 112 is rotatably mounted within tub 108 such that it is rotatable about an axis of rotation 10. According to the illustrated embodiment, the axis of rotation 10 is substantially parallel to the vertical direction V. In this regard, washing machine appliance 100 is generally referred to as a "vertical axis" or "top load" washing machine appliance 100. However, as noted above, it should be appreciated that aspects of the present subject matter may be used within the context of a horizontal axis or front load washing machine appliance as well.

As illustrated, cabinet 102 of washing machine appliance 100 has a top panel 118. Top panel 118 defines an opening (FIG. 2) that coincides with opening 116 of wash basket 112 to permit a user access to wash basket 112. Washing machine appliance 100 further includes a door 120 which is rotatably mounted to top panel 118 to permit selective access to opening 116. In particular, door 120 may be selectively rotated between a closed position (as shown in FIGS. 1 and 3) and a fully open position (as shown in FIG. 2). Additionally, door 120 may be rotated to a plurality of partially open positions between the fully open position and the fully closed position. When door 120 is closed, access is inhibited to wash basket 112. Conversely, when door 120 is open, a user can access wash basket 112. A window 122 in door 120 permits viewing of wash basket 112 when door 120 is closed, e.g., during operation of washing machine appliance 100. Door 120 also includes a handle 124 that, e.g., a user may pull and/or lift when opening and closing door 120.

As best shown in FIGS. 2 and 3, wash basket 112 further defines a plurality of perforations 126 to facilitate fluid communication between an interior of wash basket 112 and tub 108. In this regard, wash basket 112 is spaced apart from tub 108 to define a space for wash fluid to escape wash chamber 114. During a spin cycle, wash fluid within articles of clothing and within wash chamber 114 is urged through perforations 126 wherein it may collect in a sump 128 defined by tub 108. Washing machine appliance 100 further includes a pump assembly 130 (FIG. 3) that is located beneath tub 108 and wash basket 112 for gravity assisted flow when draining tub 108, e.g., after a wash or rinse cycle.

An impeller or agitation element 132 (FIG. 3), such as a vane agitator, impeller, auger, oscillatory basket mechanism, or some combination thereof may be disposed in wash basket 112 to impart an oscillatory motion to articles and liquid in wash basket 112. More specifically, agitation element 132 may extend into wash basket and assist agitation of articles disposed within wash basket 112 during operation of washing machine appliance 100, e.g., to facilitate improved cleaning. In different embodiments, agitation element 132 may include a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitation element 132 and wash basket 112 may be oriented to rotate about the axis of rotation 10 (which is substantially parallel to vertical direction V).

As best illustrated in FIG. 3, washing machine appliance 100 includes a drive assembly 138 in mechanical communication with wash basket 112 to selectively rotate wash basket 112 (e.g., during an agitation or a rinse cycle of washing machine appliance 100). In addition, drive assembly 138 may also be in mechanical communication with agitation element 132. In this manner, drive assembly 138 may be configured for selectively rotating or oscillating wash basket 112 and/or agitation element 132 during various operating cycles of washing machine appliance 100.

More specifically, drive assembly 138 may generally include one or more of a drive motor 140 and a transmission assembly 142, e.g., such as a clutch assembly, for engaging and disengaging wash basket 112 and/or agitation element 132. According to the illustrated embodiment, drive motor 140 is a brushless DC electric motor, e.g., a pancake motor. However, according to alternative embodiments, drive motor 140 may be any other suitable type of motor. For example, drive motor 140 may be an AC motor, an induction motor, a permanent magnet synchronous motor, or any other suitable type of motor. In addition, drive assembly 138 may include any other suitable number, types, and configurations of support bearings or drive mechanisms.

As illustrated in FIGS. 1 through 3, a control panel 150 with at least one input selector 152 (FIG. 1) extends from top panel 118. Control panel 150 and input selector(s) 152 collectively form a user interface input for operator selection of machine cycles and features. For example, in one embodiment, a display 154 indicates selected features, operation mode, a countdown timer, and/or other items of interest to appliance users.

Operation of washing machine appliance 100 is controlled by a controller or processing device 156 (FIG. 1) that is operatively coupled to control panel 150 for user manipulation to select washing machine cycles and features. In response to user manipulation of control panel 150, controller 156 operates the various components of washing machine appliance 100 to execute selected machine cycles and features.

Controller 156 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 156 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of washing machine appliance 100 may be in communication with controller 156 via one or more signal lines or shared communication buses.

During operation of washing machine appliance 100, laundry items are loaded into wash basket 112 through opening 116, and washing operation is initiated through operator manipulation of input selector(s) 152. Wash basket 112 is filled with water and detergent and/or other fluid additives via dispenser drawer 110. One or more valves may be controlled by washing machine appliance 100 to provide for filling tub 108 and wash basket 112 to the appropriate level for the amount of articles being washed and/or rinsed. By way of example, for a wash mode, once wash basket 112 is filled with fluid to the appropriate level, the contents of wash basket 112 may be agitated (e.g., with agitation element 132 as discussed previously) for washing of laundry items in wash basket 112.

More specifically, referring to FIG. 3, a water fill process will be described according to an exemplary embodiment. As illustrated, washing machine appliance 100 includes a water supply conduit 160 (FIG. 3) that provides fluid communication between a water supply source 162 (FIG. 3; such as a municipal water supply) and a discharge nozzle 164 for directing a flow of water into tub 108, and more specifically, into wash chamber 114. In addition, washing machine appliance 100 includes a water fill valve or water control valve 166 which is fluidly coupled with water supply conduit 160 and communicatively coupled to controller 156. In this manner, controller 156 may regulate the operation of water control valve 166 to regulate the amount of water within tub 108.

After tub 108 is filled and the agitation phase of the wash cycle is completed, wash basket 112 can be drained, e.g., by drain pump assembly 130. Laundry articles can then be rinsed by again adding fluid to wash basket 112 depending on the specifics of the cleaning cycle selected by a user. The impeller or agitation element 132 may again provide agitation within wash basket 112. One or more spin cycles may also be used as part of the cleaning process. In particular, a spin cycle may be applied after the wash cycle and/or after the rinse cycle in order to wring wash fluid from the articles being washed. During a spin cycle, wash basket 112 is rotated at relatively high speeds to help wring fluid from the laundry articles through perforations 126. After articles disposed in wash basket 112 are cleaned and/or washed, the user can remove the articles from wash basket 112, e.g., by reaching into wash basket 112 through opening 116.

Referring now to FIGS. 4 through 7, a balance ring 200 that may be used with a laundry appliance, such as washing machine appliance 100, will be described according to example embodiments of the present subject matter. The balance ring 200 generally defines a radial direction R, an axial direction A, and a circumferential direction C such that a cylindrical coordinate system is generally defined. The term "radial" refers to the relative direction that is substantially perpendicular to an axial centerline of balance ring 200. The term "axially" refers to the relative direction that is substantially parallel and/or coaxially aligned to an axial centerline of balance ring 200. The term "circumferentially" refers to the relative direction that extends around the axial centerline of balance ring 200. Although balance ring 200 is described herein as being used with washing machine appliance 100, it should be appreciated that balance ring 200 may be used on any other suitable laundry appliance, e.g., such as a horizontal axis washing machine appliance, a combination washer/dryer appliance, or any other suitable appliance for correcting out-of-balance conditions of the laundry appliance. Although an exemplary construction of balance ring 200 is described herein, it should be appreciated that variations and modifications may be made to balance ring 200 while remaining within the scope of the present subject matter.

Figure 4:
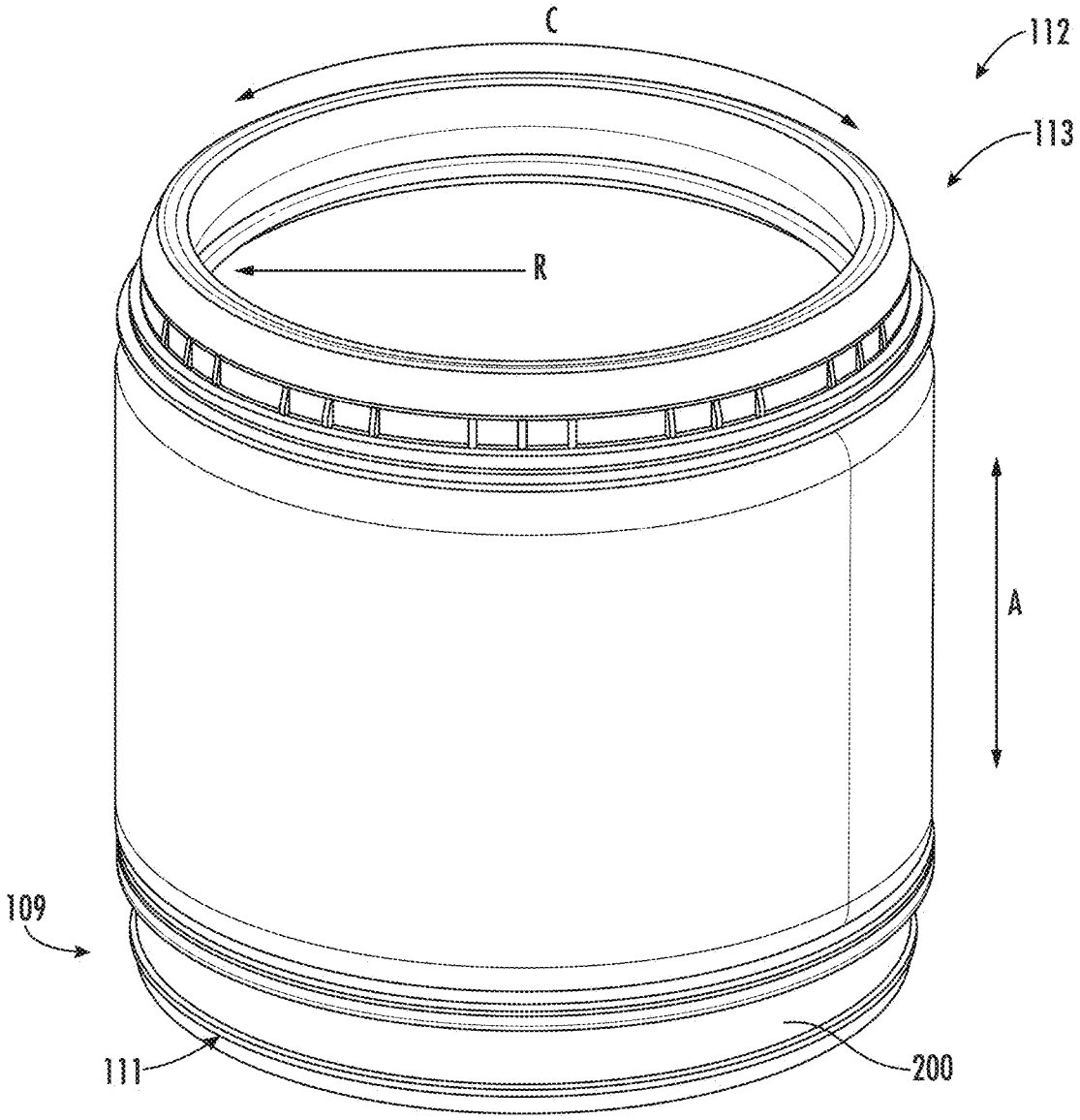
FIG. 4 provides a perspective view of a wash basket of the washing machine appliance of FIG. 1 according to an exemplary embodiment of the present subject matter with a balance ring positioned on the bottom of the wash basket.

According to example embodiments, balance ring 200 may be mounted or otherwise positioned on wash basket 112 of washing machine appliance 100. For example, as illustrated in FIG. 4, balance ring 200 may be mounted to a bottom 109 of wash basket 112, such as around a bottom exterior surface 111 of wash basket 112. In this respect, balance ring 200 may be better positioned to counterbalance wash basket 112 when articles and/or fluid within wash basket 112 cause wash basket 112 to be out of balance and, thus, better positioned to correct out-of-balance conditions of washing machine appliance 100. However, it should be appreciated that balance ring 200 may be mounted or otherwise positioned on wash basket 112 in any suitable location on wash basket 112, such as a top 113 of wash basket 112.

Figure 5:
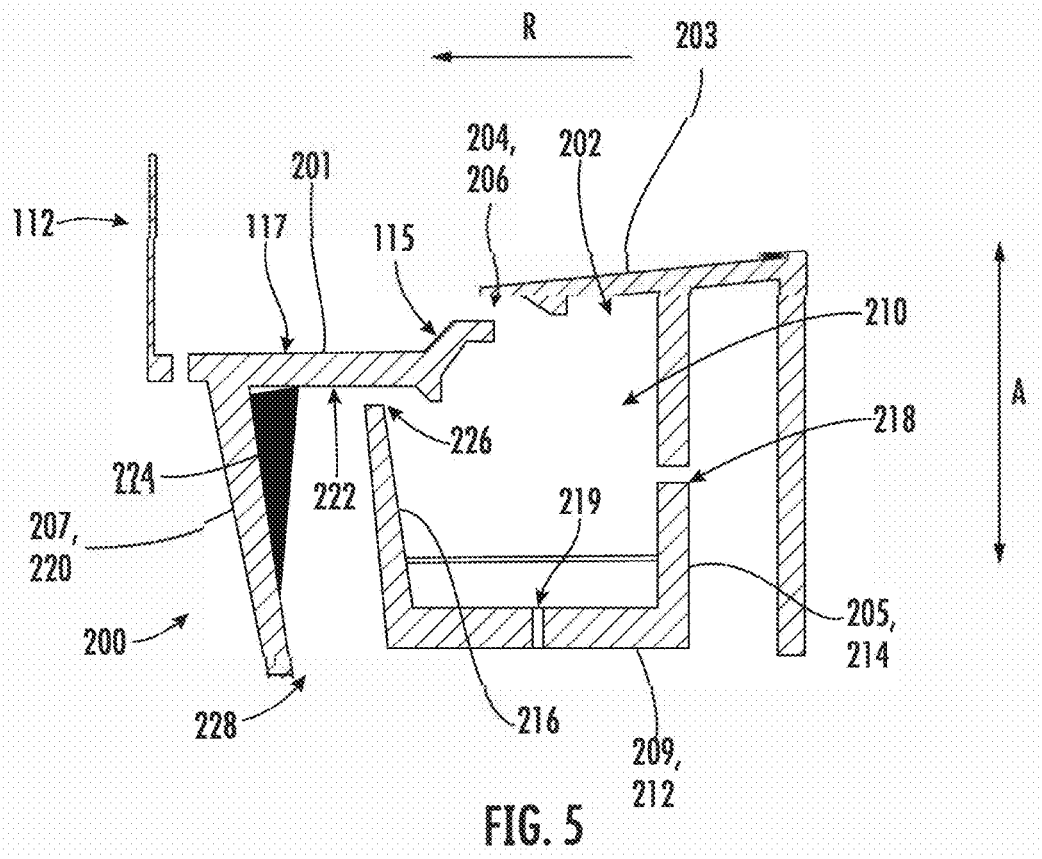
FIG. 5 provides a side cross-sectional view of the balance ring of FIG. 4 according to a first exemplary embodiment of the present subject matter.
Figure 6:
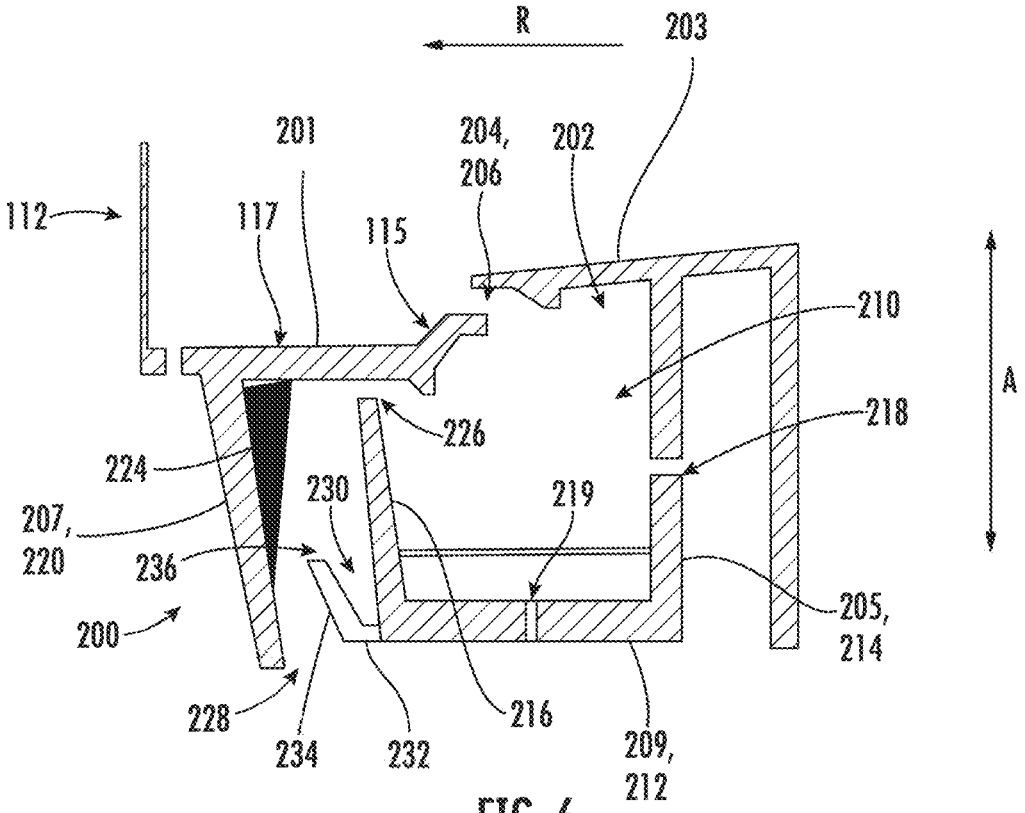
FIG. 6 provides a side cross-sectional view of the balance ring of FIG. 4 according to a second exemplary embodiment of the present subject matter.
Figure 7:
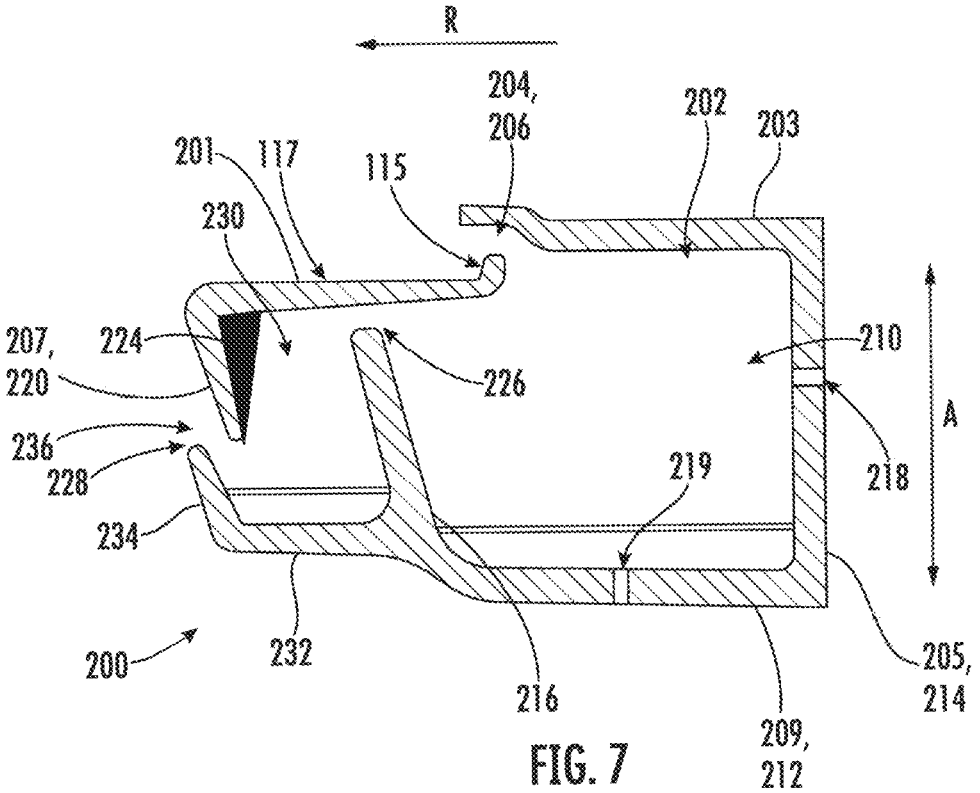
FIG. 7 provides a side cross-sectional view of the balance ring of FIG. 4 according to a third exemplary embodiment of the present subject matter.

According to example embodiments, balance ring 200 may include a plurality of walls that extend annularly in circumferential direction C and collectively define the boundaries of a balance ring interior 202 of balance ring 200. The balance ring 200 may include a first wall 201, a second wall 203, a third wall 205, a fourth wall 207, and a fifth wall 209 collectively defining balance ring interior 202. However, it should be appreciated that balance ring 200 may include any suitable number of walls that define the boundaries of balance ring interior 202. As illustrated in FIGS. 5 through 7, first wall 201 and second wall 203 may collectively correspond to a top or ceiling of balance ring interior 202. Additionally, third wall 205 and fourth wall 207 may be spaced apart from each other in radial direction R, and may extend downward from the first wall 201 and the second wall 203 of balance ring interior 202 in axial direction A. Furthermore, fifth wall 209 may correspond to a bottom or floor of balance ring interior 202 positioned below the ceiling of balance ring interior 202 in axial direction A and between third wall 205 and fourth wall 207.

According to example embodiments, balance ring interior 202 contains fluid within. The fluid contained within balance ring interior 202 is utilized within balance ring interior 202 for correcting an out-of-balance condition of a laundry appliance, such as washing machine appliance 100. The fluid corresponds to fluid contained within another portion of the laundry appliance, such as wash basket 112 of washing machine appliance 100. As such, balance ring interior 202 is fluidly coupled to wash basket 112 so that fluid from wash basket 112 and, thus, from tub 108, is permitted to flow into and/or out of balance ring interior 202. For example, balance ring 200 includes a fluid inlet 204 extending from wash basket 112 of washing machine appliance 100 into balance ring interior 202. Thus, the fluid inlet 204 permits fluid, such as wash fluid, to flow from wash basket 112 into balance ring interior 202. In this respect, balance ring 200 utilizes fluid within wash basket 112 and, thus, fluid within tub 108, for correcting an out-of-balance condition of washing machine appliance 100. Although fluid inlet 204 is described herein as fluidly connecting wash basket 112 and balance ring interior 202, it should be appreciated that fluid inlet 204 may fluidly couple balance ring interior 202 to any other suitable portion of washing machine appliance 100 such that fluid is permitted to flow externally from balance ring 200 into balance ring interior 202. For example, fluid inlet 204 may fluidly couple balance ring interior 202 directly to tub 108, such that fluid may flow directly from tub 108 into balance ring interior 202 and, thus, effectively bypassing wash basket 112.

According to example embodiments, fluid inlet 204 may correspond to a fluid gap 206 defined between adjacent walls of balance ring 200. For example, as illustrated in FIGS. 5 through 7, second wall 203 may be positioned above and spaced apart from first wall 201 in axial direction A. The fluid gap 206 may be defined between first wall 201 and second wall 203. In this respect, fluid may flow from wash basket 112, between first wall 201 and second wall 203, and into balance ring interior 202.

According to example embodiments, fluid inlet 204 may extend from an axially extending surface of wash basket 112 and into balance ring interior 202. For example, as best illustrated in FIGS. 5 through 7, wash basket 112 may include an interior side surface 115 and an interior bottom end surface 117 positioned within wash basket 112. The interior side surface 115 may extend from interior bottom end surface 117, such as upwardly from interior bottom end surface 117 in axial direction A. The fluid inlet 204 may extend from interior side surface 115 and into balance ring interior 202 to permit fluid to flow from wash basket 112 and into balance ring interior 202. Additionally, fluid inlet 204 may be spaced apart from interior bottom end surface 117. For example, fluid inlet 204 may be spaced apart from bottom end surface 117 such that at least a portion of interior side surface 115 is positioned between fluid inlet 204 and interior bottom end surface 117. As such, the portion of interior side surface 115 positioned between fluid inlet 204 and interior bottom end surface 117 acts as a fluid levee or barrier to limit the quantity of fluid that flows into balance ring interior 202. In some embodiments, such as when wash basket 112 is cylindrically shaped, interior side surface 115 may correspond to an interior circumferential surface. However, it should be appreciated that, in other embodiments, interior side surface 115 may correspond to any other suitable shape or form.

Additionally, or alternatively, in some embodiments, fluid inlet 204 may extend radially, e.g., inward generally along radial direction R, from wash basket 112 into balance ring interior 202. For example, as illustrated in FIGS. 5 through 7, fluid channel 206 may extend inward generally along radial direction R from interior side surface 115 of wash basket 112 into balance ring interior 202. In this respect, the fluid from wash basket 112 and, thus, from tub 108, is permitted to flow radially, e.g., inward generally along radial direction R from wash basket 112, through fluid inlet 204, and into balance ring interior 202.

According to example embodiments, balance ring 200 may include one or more fluid reservoirs positioned within balance ring interior 202 for containing or holding fluid therein, such as the fluid that flows into balance ring interior 202 from wash basket 112. For example, as illustrated in FIGS. 5 through 7, balance ring 200 may include a primary fluid reservoir 210 positioned within balance ring interior 202. As such, primary fluid reservoir 210 may include a plurality of walls which contain or hold fluid therebetween. For example, primary fluid reservoir 210 may include a primary reservoir bottom wall 212, which may correspond fifth wall 209 of balance ring 200. Additionally, primary fluid reservoir 210 may include a primary reservoir inner wall 214, which may correspond to third wall 205 of balance ring 200, and a primary reservoir outer wall 216 spaced radially apart from each other and extending upwardly in axial direction A from primary reservoir bottom wall 212. The primary reservoir outer wall 216 may be spaced radially outward from primary reservoir inner wall 214. Furthermore, fluid inlet 204 may extend into primary fluid reservoir 210. In this respect, fluid is permitted to flow from wash basket 112 into primary fluid reservoir 210. As will be described below, after the fluid flows into primary fluid reservoir 210, rotation of wash basket 112 may result in the fluid collectively moving onto a retaining wall within balance ring interior 202.

According to example embodiments, balance ring 200 may include one or more primary reservoir drain outlets. The reservoir drain outlet(s) may extend from primary fluid reservoir 210 and into tub 108 of washing machine appliance 100 to permit fluid to drain directly from primary fluid reservoir 210 and into tub 108. In this respect, the level of the fluid within primary fluid reservoir 210 may be regulated to inhibit overfilling of primary fluid reservoir 210, such as prior to rotation of wash basket 112. For example, as illustrated in FIGS. 5 through 7, balance ring 200 may include a primary reservoir side drain outlet 218. The primary reservoir side drain outlet 218 may extend through primary reservoir inner wall 214 and may be positioned between a top and a bottom of primary fluid reservoir 210. In this respect, fluid within primary fluid reservoir 210 may be permitted to drain from primary fluid reservoir through primary reservoir side drain outlet 218 so that the level of the fluid within primary fluid reservoir 210 is lowered until it at least reaches primary reservoir side drain outlet 218.

Additionally, or alternatively, in some embodiments, balance ring 200 may include a primary reservoir bottom drain outlet 219. The primary reservoir bottom drain outlet 219 may extend through primary reservoir bottom wall 212. In this respect, fluid within primary fluid reservoir 210 may be permitted to drain from primary fluid reservoir through primary reservoir bottom drain outlet 219.

According to example embodiments, balance ring 200 may include a fluid retaining wall 220. The fluid retaining wall 220 may correspond to fourth wall 207 of balance ring 200. The fluid retaining wall 220 may protrude from a surface into balance ring interior 202. For example, as best illustrated in FIGS. 5 through 7, balance ring 200 may include a top interior surface 222 positioned within balance ring interior 202 and above at least a portion of balance ring interior 202 in axial direction A. The fluid retaining wall 220 may be positioned on top interior surface 222 and protrude downwardly from top interior surface 222 into balance ring interior 202. Although fluid retaining wall 220 is described herein as being positioned on top interior surface 222, it should be appreciated that fluid retaining wall 220 may be positioned on any other suitable surface and protrude into balance ring interior 202.

During rotation of wash basket 112, a centrifugal force may act on the fluid within balance ring interior 202 and, thus, cause the fluid to collectively move onto fluid retaining wall 220. As best illustrated in FIGS. 5 through 7, fluid retaining wall 220 is utilized as a barrier for holding a quantity of fluid 224 thereon when the centrifugal force is acting on the quantity of fluid 224. The force/pressure of the quantity of fluid 224 on the retaining wall 220 during rotation of the wash basket 112 helps balance ring 200 counterbalance wash basket 112 when articles and/or fluid within wash basket 112 make wash basket 112 out of balance and, thus, correct an out-of-balance condition of washing machine appliance 100.

After the fluid flows into the fluid reservoir(s), such as the primary fluid reservoir 210, rotation of wash basket 112 may permit the fluid to collectively move onto fluid retaining wall 220 so that balance ring 200 provides a counterbalance to wash basket 112 and, thus, correct an out-of-balance condition of washing machine appliance 100. In some embodiments, the fluid within primary fluid reservoir 210 may move out of primary fluid reservoir 210 and onto fluid retaining wall 220. In this respect, fluid retaining wall 220 may be positioned radially outward in radial direction R of primary fluid reservoir 210. Additionally, fluid retaining wall 220 and primary reservoir outer wall 216 of primary fluid reservoir 210 may be adjacent to and radially spaced apart from each other in radial direction R. Moreover, a fluid gap or pathway 226 may be defined between primary fluid reservoir 210, such as the primary reservoir outer wall 216, and the surface from which fluid retaining wall 220 protrudes, such as top interior surface 222 of balance ring interior 202. As such, the centrifugal force applied to the fluid within primary fluid reservoir 210 by rotation of wash basket 112 may cause at least a portion of the fluid to collectively move, or move together as unit or with little to no separation, upward in axial direction A along primary reservoir outer wall 216 and then through fluid gap 226 onto fluid retaining wall 220.

Although fluid retaining wall 220 is described herein as being positioned outside of primary fluid reservoir 210, it should be appreciated that fluid retaining wall 220 may be positioned at any suitable location within balance ring interior 202 such that fluid may move thereon during rotation of wash basket 112, such as within primary fluid reservoir 210. For example, fluid retaining wall 220 may correspond to primary reservoir outer wall 216 of primary fluid reservoir 210.

According to example embodiments, fluid retaining wall 220 may be obliquely sloped thereby inhibiting the fluid that moved onto fluid retaining wall 220 from moving off fluid retaining wall 220 while wash basket 112 is rotating. For example, as illustrated in FIGS. 5 through 7, fluid retaining wall 220 may slope obliquely from top interior surface 222 of balance ring interior 202 inward in axial direction A toward primary reservoir outer wall 216. In this respect, fluid retaining wall 220 may thereby inhibit gravity or other forces acting on the fluid from moving the fluid off fluid retaining wall 220 while wash basket 112 is rotating.

In some embodiments, once rotation of wash basket 112 has slowed or stopped, fluid may move off fluid retaining wall 220 and exit balance ring 200 and into tub 108. For example, fluid retaining wall 220 may be positioned within tub 108 or over/above tub 108 in axial direction A. In this respect, fluid may move off fluid retaining wall 220 and directly into tub 108 once rotation of wash basket 112 has slowed or stopped. Thereafter, the fluid within tub 108 and wash basket 112 can be drained, e.g., by drain pump assembly 130.

In some embodiments, balance ring 200 may include a secondary fluid reservoir 230. The secondary fluid reservoir 230 may include a plurality of walls which contain or hold fluid therebetween. For example, secondary reservoir 230 may include a secondary reservoir bottom wall 232, which, as illustrated in FIGS. 6 and 7, may protrude outward in radial direction R from primary reservoir outer wall 216. Additionally, secondary fluid reservoir 230 may include a secondary reservoir outer wall 234, which may protrude upward from secondary reservoir bottom wall 232 at least partially in axial direction A. The secondary reservoir outer wall 234 may also be spaced apart from primary reservoir outer wall 216 in radial direction R such that fluid may be contained between secondary reservoir outer wall 234 and primary reservoir outer wall 216.

The secondary fluid reservoir 230 may be positioned outside of primary fluid reservoir 210 and directly below fluid gap 226 in axial direction A. In this respect, secondary fluid reservoir 230 may be positioned to receive fluid that is spilled from primary fluid reservoir 210. Additionally, as illustrated in FIG. 7, in some embodiments, secondary fluid reservoir 230 may be positioned directly below fluid retaining wall 220. In this respect, secondary fluid reservoir 230 may be positioned to receive fluid that moves off fluid retaining wall 220, such as once rotation of wash basket 112 slows or stops.

In some embodiments, balance ring 200 may include a primary fluid outlet 228 for permitting fluid to exit balance ring 200. The fluid outlet 228 may correspond to a fluid gap 236 defined between adjacent walls of balance ring 200. For example, as illustrated in FIGS. 6 and 7, secondary reservoir outer wall 234 may be spaced apart from fluid retaining wall 220 in radial direction R. The fluid gap 236 may be defined between secondary reservoir outer wall 234 and fluid retaining wall 220. In this respect, during rotation of wash basket 112, the fluid within secondary fluid reservoir 230 may collectively move upward in axial direction A along secondary reservoir outer wall 234 and between secondary reservoir outer wall 234 and fluid retaining wall 220 and exit balance ring 200 into tub 108. Thereafter, the fluid within tub 108 and wash basket 112 can be drained, e.g., by drain pump assembly 130.

As explained herein, aspects of the present subject matter are generally directed to a laundry appliance balance ring for correcting an out-of-balance condition of a laundry appliance. For example, the balance ring includes a fluid inlet extending from the basket of the laundry appliance into the balance ring interior to permit fluid to flow from the basket into the balance ring interior. The balance ring also includes a fluid retaining wall protruding into the balance ring interior. After the fluid flows from the basket of the laundry appliance into the balance ring interior, rotation of the basket permits fluid within the balance ring interior to collectively move onto the retaining wall for providing balance to the basket during rotation.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A top load washing machine appliance defining a vertical direction, a lateral direction, and a transverse direction, the top load washing machine appliance comprising:

a cabinet;

a tub positioned within the cabinet;

a vertically oriented basket rotatably mounted within the tub, the basket defining a wash chamber for receipt of articles for washing; and a balance ring positioned on a bottom of the basket and defining a balance ring interior, the balance ring comprising:

a fluid inlet extending radially into the balance ring interior such that the fluid inlet permits fluid to flow radially into the balance ring interior; and a fluid retaining wall protruding from a surface into the balance ring interior, wherein, after the fluid flows into the balance ring interior, rotation of the basket permits the fluid to collectively move onto the fluid retaining wall for providing balance to the basket during rotation of the basket.

2. The top load washing machine appliance of claim 1, wherein:

the fluid inlet extends radially and directly from the tub into the balance ring interior such that fluid inlet permits the fluid to flow radially from the tub into the balance ring interior.

3. The top load washing machine appliance of claim 1, wherein:

the basket includes an interior bottom surface and an interior side surface extending vertically from the interior bottom surface; and the fluid inlet extends radially from the interior side surface of the basket into the balance ring interior such that the fluid inlet permits the fluid to flow radially from the basket into the balance ring interior.

4. The top load washing machine appliance of claim 1, wherein:

the fluid retaining wall is obliquely sloped thereby such that the fluid retaining wall inhibits the fluid from moving off the fluid retaining wall during rotation of the basket.

5. The top load washing machine appliance of claim 1, wherein:

the balance ring includes a fluid reservoir positioned within the balance ring interior for holding the fluid prior to the fluid collectively moving onto the fluid retaining wall; and the fluid inlet extends from the basket into the fluid reservoir such that the fluid inlet permits the fluid to flow from the basket into the fluid reservoir.

6. The top load washing machine appliance of claim 5, wherein:

the fluid reservoir includes an outer wall adjacent to and spaced apart from the fluid retaining wall; and a gap is defined between the outer wall and the surface from which the fluid retaining wall protrudes such that the gap permits the fluid to move from the fluid reservoir onto the fluid retaining wall during rotation of the basket.

7. A laundry appliance defining a vertical direction, a lateral direction, and a transverse direction, the laundry appliance comprising:

a cabinet;

a tub positioned within the cabinet;

a basket rotatably mounted within the tub and defining a chamber for receipt of articles, the basket including an interior end surface and an interior circumferential surface extending from the interior end surface; and a balance ring positioned on the basket and defining a balance ring interior, the balance ring comprising:

a fluid inlet extending from the interior circumferential surface of the basket into the balance ring interior such that the fluid inlet permits fluid to flow from the basket into the balance ring interior; and a fluid retaining wall protruding from a surface into the balance ring interior, wherein, after the fluid flows into the balance ring interior, rotation of the basket permits the fluid to collectively move onto the fluid retaining wall for providing balance to the basket during rotation of the basket.

8. The laundry appliance of claim 7, wherein:

the fluid inlet extends radially from the interior circumferential surface of the basket into the balance ring interior such that the fluid inlet permits the fluid to flow radially from the basket into the balance ring interior.

9. The laundry appliance of claim 7, wherein:

the fluid inlet is spaced apart from the interior end surface such that a portion of the interior circumferential surface is positioned between the fluid inlet and the interior end surface.

10. The laundry appliance of claim 7, wherein:

the fluid retaining wall is obliquely sloped such that the fluid retaining wall inhibits the fluid from moving off the fluid retaining wall during rotation of the basket.

11. The laundry appliance of claim 7, wherein:

the balance ring includes a fluid reservoir positioned within the balance ring interior for holding the fluid prior to the fluid collectively moving onto the fluid retaining wall; and the fluid inlet extends from the basket into the fluid reservoir such that the fluid inlet permits the fluid to flow from the basket into the fluid reservoir.

12. The laundry appliance of claim 11, wherein:

the fluid retaining wall is positioned radially outward from the fluid reservoir within the balance ring interior.

13. The laundry appliance of claim 11, wherein:

the fluid reservoir includes an outer wall adjacent to and spaced apart from the fluid retaining wall; and a gap is defined between the outer wall and the surface from which the fluid retaining wall protrudes such that the gap permits the fluid to move from the fluid reservoir onto the fluid retaining wall during rotation of the basket.

14. The laundry appliance of claim 13, wherein:

the fluid reservoir corresponds to a primary fluid reservoir; and the balance ring further includes a secondary fluid reservoir positioned within the balance ring interior outside of the primary fluid reservoir and below the gap defined between the outer wall and the surface from which the fluid retaining wall protrudes for permitting the secondary fluid reservoir to receive fluid that is spilled from the primary fluid reservoir.

15. The laundry appliance of claim 14, wherein:

the secondary fluid reservoir is also positioned below the fluid retaining wall to receive fluid that moves off the fluid retaining wall.

16. The laundry appliance of claim 11, the balancing ring further comprising:

a reservoir drain outlet extending from the fluid reservoir to the tub of the laundry appliance such that the reservoir drain outlet permits the fluid to drain directly from the fluid reservoir into the tub.

17. The laundry appliance of claim 16, wherein:

the fluid reservoir includes an inner wall; and the reservoir drain outlet extends through the inner wall and is positioned between a top and a bottom of the fluid reservoir such that the reservoir drain outlet permits the fluid to drain from the fluid reservoir so that a level of the fluid within the fluid reservoir at least reaches the reservoir drain outlet.

18. The laundry appliance of claim 16, wherein:

the reservoir drain outlet extends through a bottom wall of the fluid reservoir such that the reservoir drain outlet permits the fluid to drain from the fluid reservoir so that a level of the fluid within the fluid reservoir is regulated.

19. The laundry appliance of claim 7, wherein:

the laundry appliance is configured as a top load washing machine appliance; and the basket is a vertically oriented basket.

20. The laundry appliance of claim 19, wherein:

the balance ring is positioned on a bottom of the vertically oriented basket.

* * * * *